US012247470B1

(12) United States Patent
Alcantar et al.

(10) Patent No.: US 12,247,470 B1
(45) Date of Patent: Mar. 11, 2025

(54) ENHANCING CONNECTIVITY BETWEEN INJECTOR AND PRODUCER WELLS USING SEQUENCED STIMULATION

(71) Applicant: MAZAMA ENERGY, INC., Seattle, WA (US)

(72) Inventors: Jonathan Alcantar, Plano, TX (US); Gabrijel Grubac, Zrenjanin (RS); Abdel Wadood Mohamed El-Rabaa, Plano, TX (US); Sriram Vasantharajan, Plano, TX (US)

(73) Assignee: MAZAMA ENERGY, INC., Seattle, WA (US)

( * ) Notice: Subject to any disclaimer, the term of this patent is extended or adjusted under 35 U.S.C. 154(b) by 0 days.

(21) Appl. No.: 18/801,992

(22) Filed: Aug. 13, 2024

Related U.S. Application Data

(60) Provisional application No. 63/662,134, filed on Jun. 20, 2024.

(51) Int. Cl.
*E21B 43/17* (2006.01)

(52) U.S. Cl.
CPC ..... *E21B 43/17* (2013.01); *E21B 2200/20* (2020.05)

(58) Field of Classification Search
CPC ..... E21B 43/17; E21B 3300/20; E21B 43/16; E21B 43/26
See application file for complete search history.

(56) References Cited

U.S. PATENT DOCUMENTS

| | | | |
|---|---|---|---|
| 3,650,337 | A | 3/1972 | Andrews et al. |
| 4,912,941 | A | 4/1990 | Buchi |
| 4,974,675 | A | 12/1990 | Austin et al. |
| 5,482,116 | A | 1/1996 | El-Rabaa et al. |
| 6,347,675 | B1 | 2/2002 | Kolle |
| 6,543,538 | B2 | 4/2003 | Tolman et al. |
| 7,331,385 | B2 | 2/2008 | Symington et al. |
| 7,490,657 | B2 | 2/2009 | Ueyama |
| 7,631,691 | B2 | 12/2009 | Symington et al. |
| 8,201,626 | B2 | 6/2012 | Balczewski |
| 8,540,020 | B2 | 9/2013 | Stone et al. |
| 8,863,839 | B2 | 10/2014 | Kaminsky et al. |
| 9,074,794 | B2 | 7/2015 | Suryanarayana et al. |
| 9,080,441 | B2 | 7/2015 | Meurer et al. |
| 9,284,819 | B2 | 3/2016 | Tolman et al. |
| 9,322,239 | B2 | 4/2016 | Boza et al. |
| 9,328,600 | B2 | 5/2016 | Kaminsky et al. |
| 9,541,309 | B2 | 1/2017 | Colwell |

(Continued)

FOREIGN PATENT DOCUMENTS

| | | | |
|---|---|---|---|
| WO | WO2011005075 | A1 | 1/2011 |
| WO | WO2012173916 | A1 | 12/2012 |

(Continued)

OTHER PUBLICATIONS

U.S. Dept. of Energy, "*What is an Enhanced Geothermal System (EGS)*?", DOE/EE-0785, Sep. 2012.

(Continued)

*Primary Examiner* — Silvana C Runyan
(74) *Attorney, Agent, or Firm* — Jeffrey L. Wendt; THE WENDT FIRM, P.C.

(57) ABSTRACT

Systems and processes for enhancing connectivity and/or permeability between injector and producer wells using sequenced stimulation. Methods of modeling same.

24 Claims, 9 Drawing Sheets

(56) References Cited

U.S. PATENT DOCUMENTS

| | | | | |
|---|---|---|---|---|
| 9,703,904 | B2 | 7/2017 | Suryanarayana et al. | |
| 9,803,626 | B1 | 10/2017 | Eastman et al. | |
| 9,945,218 | B2 | 4/2018 | Tolman et al. | |
| 9,963,955 | B2 | 5/2018 | Tolman et al. | |
| 10,140,393 | B2 | 11/2018 | Hoda et al. | |
| 11,634,986 | B2 | 4/2023 | Hu et al. | |
| 2009/0126923 | A1 | 5/2009 | Montgomery | |
| 2010/0078169 | A1 | 4/2010 | Symington et al. | |
| 2010/0200237 | A1 | 8/2010 | Colgate et al. | |
| 2010/0282460 | A1 | 11/2010 | Stone et al. | |
| 2011/0067399 | A1 | 3/2011 | Rogers | |
| 2011/0146982 | A1 | 6/2011 | Kaminsky et al. | |
| 2012/0312545 | A1 | 12/2012 | Suryanarayana et al. | |
| 2013/0062055 | A1 | 3/2013 | Tolman et al. | |
| 2013/0068469 | A1 | 3/2013 | Lin et al. | |
| 2013/0112403 | A1 | 5/2013 | Meurer et al. | |
| 2013/0220604 | A1 | 8/2013 | El-Rabaa et al. | |
| 2013/0306315 | A1 | 11/2013 | Kaminsky et al. | |
| 2014/0008073 | A1* | 1/2014 | Rey-Bethbeder ..... | E21B 36/04 166/308.1 |
| 2014/0190701 | A1 | 7/2014 | Humphreys | |
| 2015/0122453 | A1 | 5/2015 | Colwell | |
| 2015/0167441 | A1 | 6/2015 | Howell et al. | |
| 2015/0247372 | A1 | 9/2015 | Boza et al. | |
| 2015/0315890 | A1 | 11/2015 | Tolman et al. | |
| 2016/0168962 | A1 | 6/2016 | Tolman et al. | |
| 2016/0169212 | A1* | 6/2016 | Hine ..... | G21D 9/00 376/273 |
| 2017/0175505 | A1* | 6/2017 | Curlett ..... | E21B 43/003 |
| 2023/0114197 | A1* | 4/2023 | Hughes ..... | F24T 10/20 165/45 |

FOREIGN PATENT DOCUMENTS

| | | | |
|---|---|---|---|
| WO | WO2015066764 | A1 | 5/2015 |
| WO | WO-2022155743 | A1 * | 7/2022 |

OTHER PUBLICATIONS

Muir, "*New Opportunities and Applications for Closed-Loop Geothermal Energy Systems*", Geothermal Rising Bulletin, Dec. 2020, vol. 49, No. 4.

Erkan, K. et al., "Understanding the Chena Hot Springs, Alaska", *Geothermics* 37 (2008) 565-585.

Leuchenberg et al., "Development and Performance of Surface Equipment for High Temperature Underbalanced Drilling in Sour, Severely Under Pressured Formation", Mobil Oil (2004) pp. 1-10.

* cited by examiner

ENHANCING CONNECTIVITY BETWEEN INJECTOR AND PRODUCER WELLS USING SEQUENCED STIMULATION

CROSS-REFERENCE TO RELATED APPLICATIONS

This application is entitled to and claims the benefit of earlier filed provisional application No. 63/662,134, filed Jun. 20, 2024, under 35 U.S.C. § 119 (e), which earlier filed provisional application is incorporated by reference herein in its entirety.

BACKGROUND INFORMATION

Technical Field

The present disclosure relates generally to systems and processes for enhancing connectivity and/or permeability between injector and producer wells using sequenced stimulation, and more particularly to systems and processes for enhancing connectivity and/or permeability between injector and producer wells in enhanced geothermal systems using sequenced stimulation.

Background Art

A naturally occurring geothermal system, known as a hydrothermal system, is defined by three key elements: heat, fluid, and permeability at depth. An Enhanced Geothermal System (EGS) is a man-made reservoir, created where there is hot rock but insufficient or little natural permeability or fluid saturation. In an EGS, fluid is injected into the subsurface under carefully controlled conditions, which cause pre-existing fractures to re-open, creating permeability. *What is an Enhanced Geothermal System (EGS)*? U. S. Dept. of Energy, DOE/EE-0785 September 2012. A different approach, closed-loop geothermal systems (CLGS), overcomes permeability issues by circulating a working fluid through a sealed downhole heat exchanger to absorb and transport heat. CLGS is a versatile technology that can be implemented in a wide variety of different well pipe configurations using a choice of working fluids (such as water and sCO2) to optimize site specific costs and performance. Muir, *New Opportunities and Applications for Closed-Loop Geothermal Energy Systems*, Geothermal Rising Bulletin, December 2020, Vol. 49, No. 4.

Extraction of heat from Dry Hot Rock (DHR) presents several efficiency and power advantages over other EGS or CLGS approaches for geothermal energy recovery. To efficiently extract DHR heat, horizontal wells are drilled within the resource. However, in order to efficiently extract DHR heat, there is a requirement of horizontal well/vertical well deployment within the basement rock to maximize area of contact. Application of drilled horizontal wells only does not yield optimal contact area with the basement rock to enable sufficient energy intensity output on the surface. Enhancing the connected pathway network is desired to increase area of exposure, harness heat by convection and conduction and efficiently maximize energy output on the surface through injector to producer well communication dynamics.

As may be seen, current practices may not be adequate for all circumstances, and do not address the noted problems with respect to extracting heat from DHR. There remains a need for more robust systems and processes for enhancing connectivity between injector and connector wells in general, and more specifically in EGS. The systems and processes of the present disclosure are directed to these needs.

SUMMARY

In accordance with the present disclosure, systems and processes are described which reduce or overcome many of the faults of previously known systems and processes. The systems and processes of increasing connectivity applies to horizontal, vertical and deviated wells contacting subterranean reservoirs. When applied to EGS, the systems and processes of the present disclosure may be used in systems below and above supercritical conditions but not limited to a minimum or maximum temperature.

A first aspect of the disclosure is a system for enhancing connectivity and/or permeability in a subterranean geologic formation (in certain embodiments, a geothermal formation between injector and producer fractures in DHR wells) comprising (or consisting essentially of, or consisting of):

(a) an injector well (cemented or uncemented) extending from a surface to a subterranean geologic formation and configured to be perforated;

(b) a pump configured to produce a thermal lattice in the subterranean geologic formation by:

(i) pumping one or more fluids at a high rate and volume and capable of tensile fracturing the subterranean geologic formation, generating a downhole pressure that produces a stress on the subterranean geologic formation exceeding Shmin, from the injector well to (or nearly to) a producer well, the producer well extending from the surface to the subterranean geologic formation;

(ii) pumping the one or more fluids in a pulsating mode (for example, but not limited to, sinusoidal) to cause fatigue to any existing natural fractures ("references") intersecting the tensile fracture, or to natural non-fractured rock, the pulsing mode having a pulse amplitude below Shmin with frequency determined by rock fabric of the subterranean geologic formation and bottom hole static temperature ("BHST");

(iii) pumping the one or more fluids in a long injection period as a hydro-shearing stage, the pump capable of pumping a volume based on an estimated total porosity of natural fractures encountered in the subterranean geologic formation estimated from a borehole logging tool or from geologic settings of the subterranean geologic formation; and (c) a measurement sub-system configured to measure enhanced connectivity and/or permeability of the subterranean geologic formation after creation of the thermal lattice.

A second aspect of the disclosure is a process for enhancing connectivity and/or permeability in a subterranean geologic formation (in certain embodiments, a geothermal formation between injector and producer fractures in DHR wells), comprising (or consisting essentially of, or consisting of):

(a) providing a perforated (cemented or uncemented) injector well extending from a surface to a subterranean geologic formation; and (b) stimulating the subterranean geologic formation to form a thermal lattice therein by sequentially:

(i) pumping one or more fluids at a high rate and volume to tensile fracture the subterranean geologic formation, generating a downhole pressure that produces a stress on the subterranean geologic formation exceeding Shmin, from the injector well to (or nearly to) a producer well, the producer well extending from the surface to the subterranean geologic formation;

(ii) pumping the one or more fluids in a pulsating mode (for example, but not limited to, sinusoidal) to cause fatigue to any existing natural fractures ("references") intersecting the tensile fracture, or to natural non-fractured rock, the pulsing mode having a pulse amplitude below Shmin with frequency controlled by the rock fabric of the subterranean geologic formation and bottom hole static temperature ("BHST");

(iii) pumping the one or more fluids in a long injection period as a hydro-shearing stage, the pump pumping a volume based on an estimated total porosity of natural fractures encountered in the subterranean geologic formation estimated from a borehole logging tool or from geologic settings of the subterranean geologic formation; and (c) measuring enhanced connectivity and/or permeability after creation of the thermal lattice.

Certain system and process embodiments may comprise wherein the subterranean geologic formation is a subterranean geothermal formation, and the injector well and producer well are in dry hot rock (DHR). In certain systems and processes of the present disclosure the injector well may be cemented. In yet other systems and processes the injector well may be uncemented.

Certain system and process embodiments may comprise wherein the production well is selected from an open hole, a well comprising an uncemented liner, and a well selectively segmented by ECP and sliding sleeves or pre-perforated liner. Certain system and process embodiments may comprise wherein the sub-system is configured to measure enhanced connectivity and/or permeability of the subterranean geologic formation after creation of the thermal lattice measures improvement in injectivity index (Q/DP), where Q is volume flow rate and DP is pressure drop.

Certain system and process embodiments may comprise wherein the sub-system is configured to measure enhanced connectivity and/or permeability of the subterranean geologic formation after creation of the thermal lattice measures pressure decline as compared by calculation of geothermal formation transmissivity (Kh/u) improvement of "references", where "Kh" is horizontal conductivity and "μ" is downhole fluid viscosity in centipoise (cp).

Certain system and process embodiments may comprise wherein the pump comprises one or more surface pumps. Yet other systems may comprise one or more surface pumps for injecting stimulation fluid in tubing or drill pipe, and one or more surface pumps for injecting the same or different stimulation fluid in the annulus.

Certain system and process embodiments may comprise wherein the one or more fluids are selected from water, brine, viscosified fluids, energizing fluids, and polymer based fluids.

In certain system and process embodiments the injector well may be selected from vertical, deviated, and horizontal injector wells.

In certain system and process embodiments the injector well may be configured to utilize single-path injection through either an inner conduit or through an annulus between the inner conduit and casing, wherein the inner conduit is selected from in place tubing, drill pipe, and coiled tubing.

In certain other system and process embodiments the injector well may utilize dual injection paths comprising a first injection path through an inner conduit and a second injection path through an annulus between the inner conduit and casing, wherein the pump comprises a first pump for the first injection path and a second pump for the second injection path, and wherein the inner conduit is selected from in place tubing, drill pipe, and coiled tubing. In these embodiments the one or more fluids may comprise a first fluid pumped by the first pump through the first injection path, and a second fluid pumped by the second pump through the second injection path, wherein the first and second fluids may be the same or different in one or more physical and/or chemical properties.

In certain other system and process embodiments the one or more fluids may comprise a propping agent, such as sand, bauxite, petroleum coke, and the like.

In certain embodiments the systems and processes of the present disclosure may comprise one or more components selected from the group consisting of one or more pressure control devices, (also referred to as chokes), one or more flow measurement devices, one or more accessory equipment, and combinations thereof. In certain embodiments the one or more accessory equipment may be selected from the group consisting of one or more connectors, one or more isolation valves, and one or more pressure relief valves. In certain embodiments the one or more components may comprise one or more redundant components in the system. Certain system embodiments may comprise one or more quick connect/quick disconnect connectors.

In certain embodiments a logic device may be provided to control all or portions of the systems and processes of the present disclosure, and the logic device may be configured to be operated and/or viewed from a Human/Machine Interface (HMI) wired or wirelessly connected to the logic device. Certain embodiments may include one or more audio and/or visual warning devices configured to receive communications from the logic device upon the occurrence of a pressure rise (or fall) in a sensed pressure above (or below) a set point pressure, or a change in concentration of one or more sensed concentrations or temperatures, or both, above one or more set points. The occurrence of a change in other measured parameters outside the intended ranges may also be alarmed in certain embodiments. Other measured parameters may include, but are not limited to, liquid or gas flow rate, and liquid density.

Certain system and process embodiments of this disclosure may operate in modes selected from the group consisting of automatic continuous mode, automatic periodic mode, and manual mode. In certain embodiments the one or more operational equipment may be selected from the group consisting of pneumatic, electric, fuel, hydraulic, and combinations thereof.

In certain embodiments, pressure (P), temperature (T), density, and/or mass flow may be sensed inside the injector and/or producer well tubing, the annulus, the subterranean geologic formation, or any combination of these. Mass flow sensors may be employed. All combinations of sensing T, P, density, and/or mass flow in the injector and/or producer tubing or inner pipe, in the annulus, and/or in the formation are disclosed herein and considered within the present disclosure.

As used herein "measurement sub-system" means a structure including a cabinet, frame, or other structural element supporting (and in some embodiments enclosing) connectivity and/or permeability measurement components and associated components, for example, but not limited to pressure control devices (backpressure valves), pressure relief devices (valves or explosion discs), pipes, conduits, vessels, towers, tanks, mass flow meters, temperature and pressure indicators, heat exchangers, pumps, compressors, and quick connect/quick disconnect (QC/QD) features for connecting and disconnecting choke umbilicals, kill umbilicals, and the like.

These and other features of the systems and processes of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain producer wells may be devoid of casing; certain injector wells may be devoid of dual injection paths; certain systems may be devoid of more than one pump; certain fluids may be devoid of oils and/or other hydrocarbons, and/or devoid of carcinogenic compounds.

BRIEF DESCRIPTION OF THE DRAWINGS

The manner in which the objectives of this disclosure and other desirable characteristics can be obtained is explained in the following description and attached drawings in which.

Figure 1A:
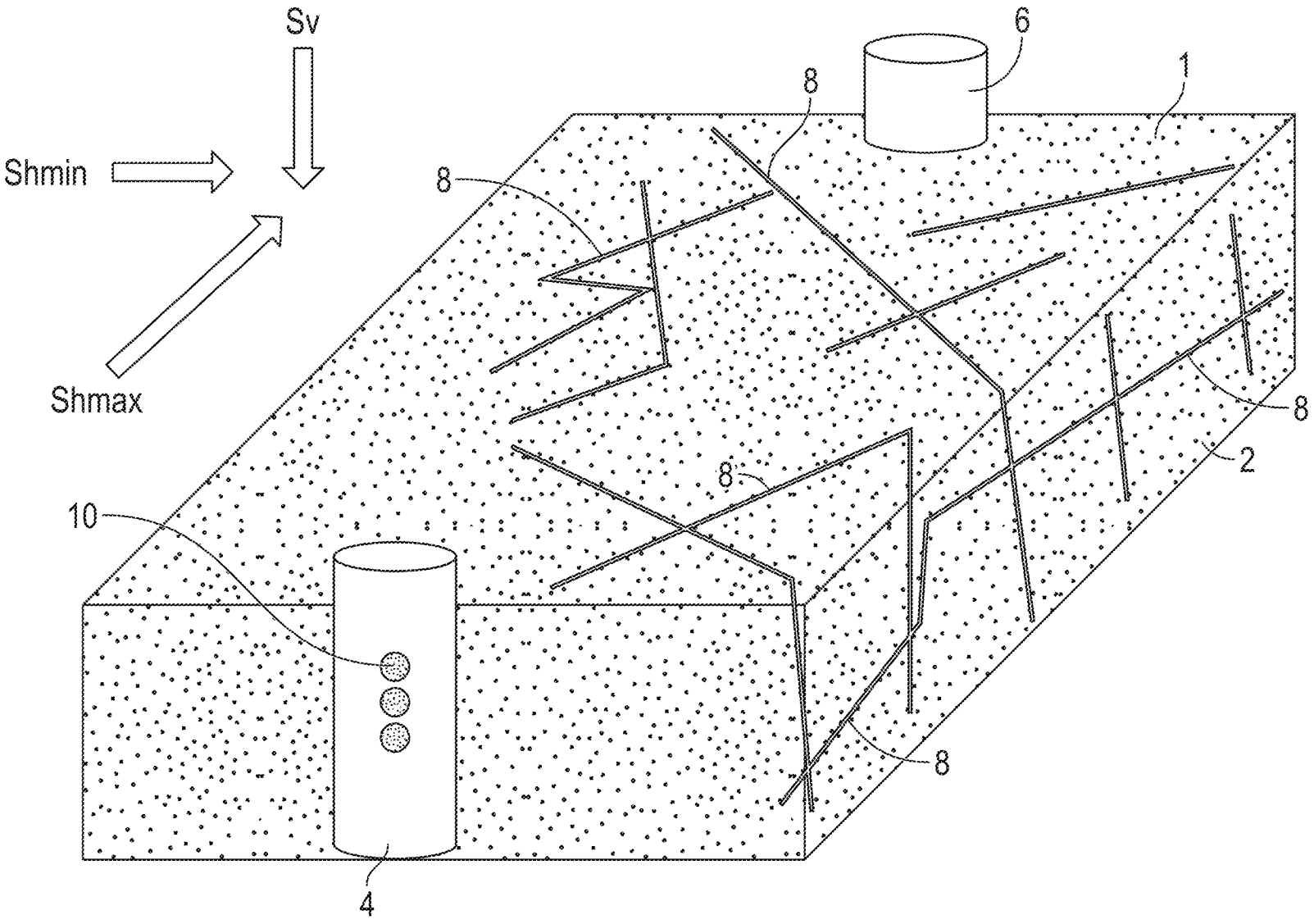
FIG. 1A is a schematic perspective illustration view of a subterranean geologic formation and an injector well and producer well just prior to employing a first fracturing session.

It is to be noted, however, that the appended drawings are not to scale, and illustrate only typical system, process, and modeling method embodiments of the present disclosure. Therefore, the drawing figures are not to be considered limiting in scope, for the disclosure may admit to other equally effective embodiments. Identical reference numerals are used throughout the several views for like or similar elements.

DETAILED DESCRIPTION

In the following description, numerous details are set forth to provide an understanding of the disclosed systems, combinations, and processes. However, it will be understood by those skilled in the art that the systems and processes disclosed herein may be practiced without these details and that numerous variations or modifications from the described embodiments may be possible. All technical articles, published and non-published patent applications, standards, patents, statutes and regulations referenced herein are hereby explicitly incorporated herein by reference, irrespective of the page, paragraph, or section in which they are referenced. Where a range of values describes a parameter, all sub-ranges, point values and endpoints within that range or defining a range are explicitly disclosed herein. All percentages herein are by weight unless otherwise noted. In the event definitions of terms in the referenced patents and applications conflict with how those terms are defined in the present application, the definitions for those terms that are provided in the present application shall be deemed controlling. Where a range of values describes a parameter, all sub-ranges, point values and endpoints within that range are explicitly disclosed herein. This document follows the well-established principle that the words "a" and "an" mean "one or more" unless we evince a clear intent to limit "a" or "an" to "one." For example, when we state "a pump configured to produce a thermal lattice by", we mean that the specification supports a legal construction of "a pump" that encompasses structure distributed among multiple physical structures, and a legal construction of "a well" that encompasses structure distributed among multiple physical structures.

As mentioned herein, extraction of heat from Dry Hot Rock (DHR) presents several efficiency and power advantages over other EGS or CLGS approaches for geothermal energy recovery. To efficiently extract DHR heat, horizontal wells are drilled within the resource. However, in order to efficiently extract DHR heat, there is a requirement of horizontal well/vertical well deployment within the basement rock to maximize area of contact. Application of drilled horizontal wells only does not yield optimal contact area with the basement rock to enable sufficient energy intensity output on the surface. Enhancing the connected pathway network is desired to increase area of exposure, harness heat by convection and conduction and efficiently maximize energy output on the surface through injector to producer well communication dynamics. As may be seen, current practices may not be adequate for all circumstances, and do not address the noted problems with respect to extracting heat from DHR. There remains a need for more robust systems and processes for enhancing connectivity between injector and connector wells in general, and particularly in EGS. The systems and processes of the present disclosure are directed to these needs.

As described in more detail herein with reference to the various drawing figures, systems and processes of the present disclosure address problems identified by the inventors herein, namely the lack of adequate connectivity and/or permeability in subterranean geologic formations, in particular DHR geothermal formations. The inventors herein investigated and developed solutions to these problems.

Turning now to the drawing figures, FIG. 1A is a schematic perspective illustration view of a subterranean geologic formation 2, an injector well 4 with perforations 10, and a producer well 6 just prior to employing a first fracturing session. Both wells extend from the surface 1 into subterranean geologic formation 2. Existing natural fractures 8, sometimes referred to as "references", are illustrated as various lines in formation 2. Illustrated by arrows are the maximum horizontal stress ("Shmax"), the minimum horizontal stress ("Shmin"), and vertical stress ("Sv") in formation 2.

An injector well 4 (vertical, deviated or horizontal) is drilled and fractured. Attempts can be made to assess fracture location and reach, using for example micro-seismic, fiber, and other techniques. A producer well 6 is drilled towards the injector well's fracture network (vertical, deviated or horizontal). Injector well 4 is stimulated, and connectivity is assessed utilizing diagnostics such as but not limited to micro-seismic, fiber, acoustic analysis, and the like. Stimulation entails tensile or shear or pulsed stimulation coupled in a customized methodology as described herein for maximum network creation to form a time stable thermal lattice. Attempts can be made to assess fracture location and reach, using micro-seismic, fiber, and other techniques.

Figure 1B:
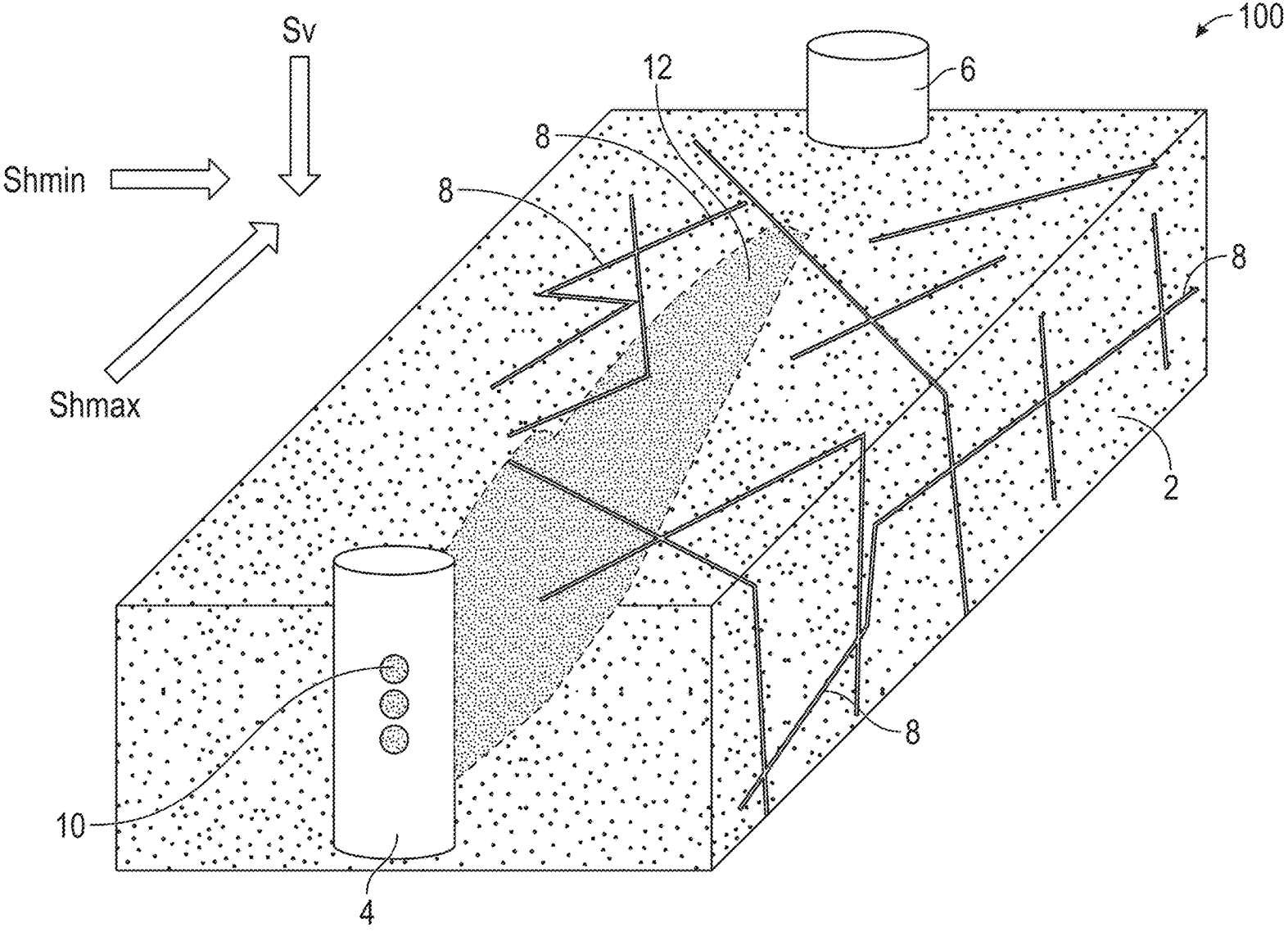
FIG. 1B is a schematic perspective illustration view of the subterranean geologic formation, injector well, and producer well of FIG. 1A after a high rate, high volume tensile fracturing session.

FIG. 1B is a schematic perspective illustration view of one system and process embodiment 100, illustrating the subterranean geologic formation 2 of FIG. 1A after a high rate, high volume tensile fracturing session with a fracturing fluid, illustrated schematically at 12, producing a stress greater than Shmin. A pump is not illustrated, but would be on the surface, downhole, or combination of these. High pressure, high rate fracturing pumps are well-known and available from various commercial suppliers, including SLB, Halliburton, Baker Hughes, and others. The plume of fracturing fluid 12 intersects with natural fractures 8, extending near producer well 6.

Figure 1C:
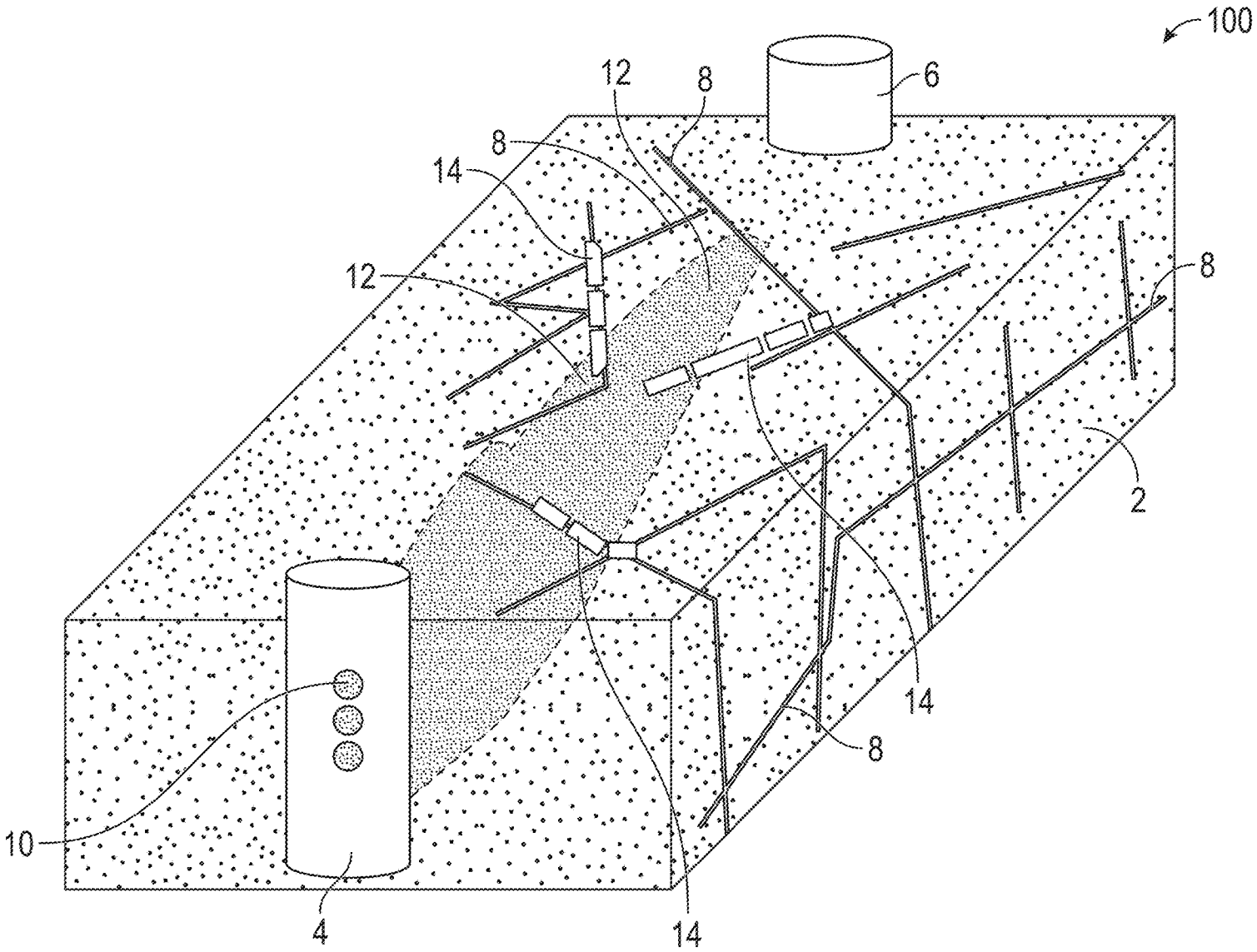
FIG. 1C is a schematic perspective illustration view of the subterranean geologic formation, injector well, and producer well of FIG. 1B after a pulse fracturing session.

FIG. 1C is a schematic perspective illustration view of the subterranean geologic formation 2, injector well 4, and producer well 6 of FIG. 1B after a pulse fracturing session producing stress less than Shmin, whereby some portion of the natural fractures 8 are expanded or opened further, as represented at 14. The fracturing fluid may further include propping agents during this stage, such as sand, bauxite particles, petroleum coke particles, and the like, which tend to maintain fractures open. The pulse fracturing employs an amplitude causing stress below Shmin, and frequency ranging from one pulse a second to one pulse every several minutes. The pulses may be uniform or non-uniform in terms of pulse shape, amplitude, and frequency. A combination of pulses may be employed, such as one pump creating a pulsed flow of fluid in the tubing having a first amplitude and a first frequency, and a second pump creating a second pulsed flow of fluid in the annulus having a second amplitude and a second frequency.

Figure 1D:
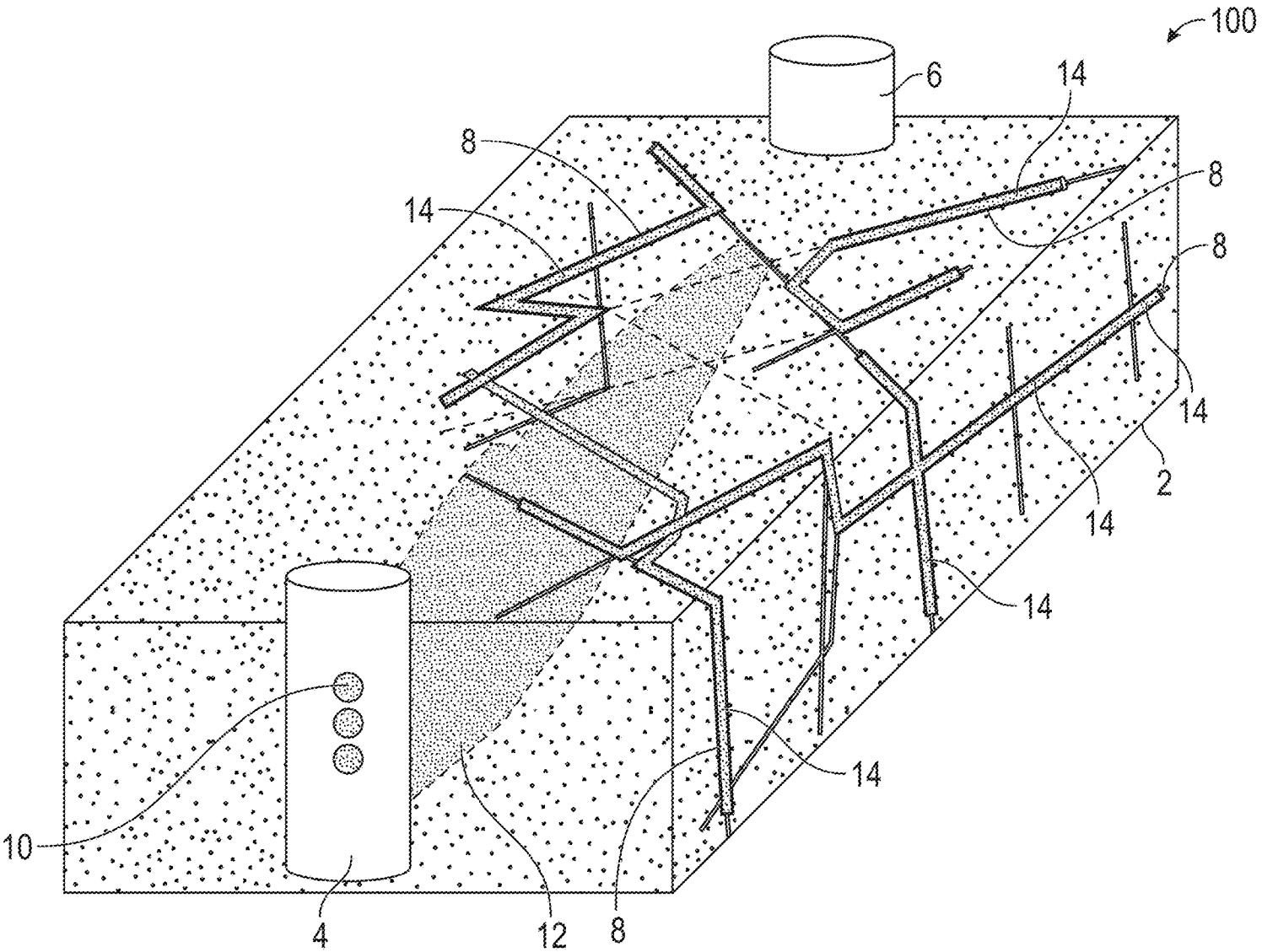
FIG. 1D is a schematic perspective illustration view of the subterranean geologic formation, injector well, and producer well of FIG. 1C after a long-duration, low volume hydro-shearing fracturing session.

FIG. 1D is a schematic perspective illustration view of the subterranean geologic formation 2, injector well 4, and producer well 6 of FIG. 1C after a long-duration, low volume hydro-shearing fracturing session producing stress/pressure less than Shmin. This stage of the process allows extensive traverse of fracturing fluid 14 into the fracture network as illustrated schematically in FIG. 1D.

Figure 2:
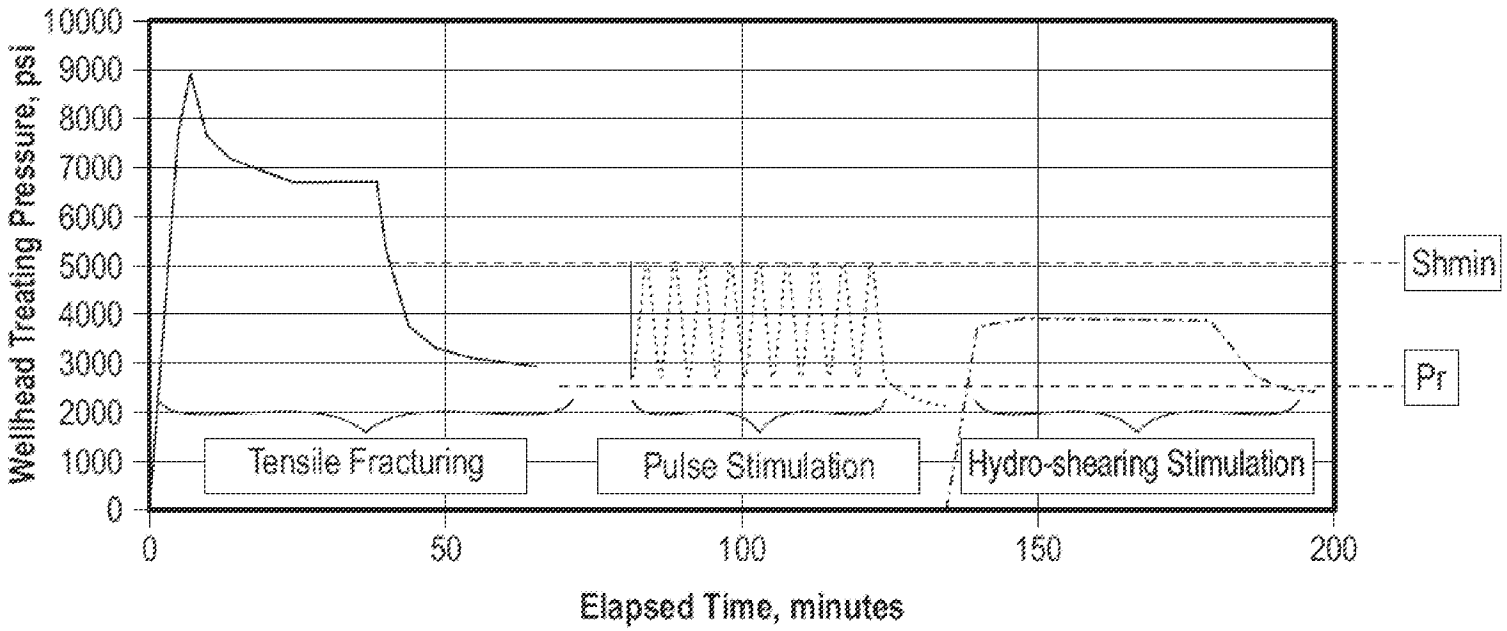
FIG. 2 is a graph schematically illustrating the fracturing sessions of FIGS. 1B, 1C, and 1D from left to right.

FIG. 2 is a graph schematically illustrating the fracturing sessions of FIGS. 1B, 1C, and 1D from left to right, illustrating that the high pressure, high volume initial fracturing stage produces a stress/pressure in the formation greater than Shmin; and that the pulse stage and hydro-shearing stages produce a maximum stress/pressure in the formation less than but approaching Shmin. The three process stages can be customized to the reservoir conditions, rock type, depth, temperature, and stresses. The initial tensile fracture serves as conduit to subsequent stimulation process to extend the thermal lattice away from the injector well and to ensure the spacing between the injector well and producer wells is well connected and its permeability is enhanced. The thermal lattice of formed as a consequence of a combination of induced longer fractures by tensile high-rate fluid injection and more intersected natural fractures existing on the path of the tensile fracture. This sequence of various injection stages can also be applied from the production wells to create an enhanced thermal lattice and increase the connectivity between injector wells and producer wells in subterranean geologic formations. The production well is extending from the surface to the subterranean geologic formation, wherein the production well can be an open hole, or comprise a cemented or uncemented liner, or selectively segmented by ECP and sliding sleeves or pre-perforated liner. "ECP" refers to "embedded cylinder pipe", which is a type of concrete pressure pipe where a welded steel cylinder is embedded within a concrete core, then wrapped with high-tensile steel wire and coated with cement mortar.

The second stimulation technique is to follow the tensile fracturing with pulsating fracturing tailored to cause fatigue to any existing natural fractures "references". The configuring amplitude of the pulse has to be below Shmin in a sinusoidal manner with frequency controlled by the rock fabric of the formation and BHST. The third stimulation is long injection period as the Hydro-shearing stage, the volume for this stage will be based on the estimated total porosity of the natural fracture encountered in the formation estimated from BHTV or similar logging tool or from geologic settings of the formation. The measure of the enhanced connectivity (permeability) after creation of the thermal lattice can be assessed using the conventional improvement in the injectivity index (Q/DP) or the analysis of pressure decline which the analysis developed in the unconventional reservoir stimulation method as compared by the calculation of the formation transmissivity ($kh/\mu$) improvement "references".

A systematic approach to enhancing connectivity between wells that can be in pairs or more (doublet or more), including:

- Tensile stimulation utilizing fluid (water, brine, energizing fluids or polymer base fluids) through dual or single injection path to generate dominant fracture pathways in hot rock;
- Hydraulic pulsed stimulation at pre-set pulse intervals to weaken the rock fabric (and fatigue the natural fractures' tip regions, if present) and allow for conductivity enhancement implemented below Shmin for host rock;
- Sub tensile geometry generation pumping methodology to connect generated pulsed tensile network to naturally occurring fracture network and fracture shear slip locations and natural fracture dilation.

Tensile stimulation of host rock utilizing water, brine, energizing fluids or polymer-based fluids may be accomplished through dual injection paths between tubing and annulus depending on intensity and reservoir rock desired location. The tubing may be tubing in place, or drill pipe, or coiled tubing. Jetting nozzles may be utilized for creating wellbore to rock fluid flow connections (connected paths). An angular abrasive material may be employed to achieve erosion and breakthrough the tubular materials separating jet nozzle tool and host rock. Dual injection in the tubing and annulus for generation of tensile fractures at desired depth may be accomplished using propping agents such as natural sands, bauxite and petroleum coke particles in sequences pertaining to a desired design.

In certain embodiments, hydraulic pulsed stimulation at pre-set pulse intervals may be employed to weaken the rock fabric and allow for conductivity enhancement—GPS (geo pulse shearing). Proprietary pressure pulse approaches utilizing water, energized fluid, brine or other viscosified fluids in pre-determined intensity and time interval between pulses may achieve rock fabric weakening and near wellbore complexity in connected fractures.

In certain embodiments a combination of high frequency pulsating action post tensile fracturing may cause more fatigue rock fracturing (non-directional);

In certain embodiments enhanced lattice/fracture networks may be created, interconnected through tensile fractures, natural fractures, shear fractures and damaged rock fabric zones;

Certain embodiments may employ single interval or multi-interval fracturing stages through single or dual injection (between tubing and annulus) for durations of time required to achieve rock fabric damage based on required frequency in pulses for respective host rock minerology;

Certain embodiments may employ a maximum pulse amplitude below Shmin and a minimum pulse amplitude below hydrostatic pressure.

In most embodiments pulse volume is directly proportional to tensile fracture volume.

The sub-tensile geometry generation pumping methodology acts to connect pulsed generated fractures in the tensile network to naturally occurring fracture network and shear slip locations. The final step of connectivity enhancement involves the application of sub-tensile geometry pumping methodology through application of hydraulic energy utilizing water, brine, energizing fluid or polymer-based fluid. The volume of fluid pumped has direct correlation to hydraulic pulse rock damage achieved as well as tensile fracture design to maximize thermal lattice creation and enhancing fracture network connectivity with the goal of achieving a uniform injector to producer flow pattern for maximized heat harvesting. A combination of stimulation techniques in a pre-determined order may be employed to magnify connection between in place natural fractures, generated tensile fractures and shear slip points in the rock. Fracture network enhancement utilizing dual injection or single injection cyclic fluid, fluid being water, polymer or energizing fluid (carbon dioxide, nitrogen) distribution in intended interval followed by tensile generation of synthetic fracture system to enhance network connectivity. Generation of enhanced near wellbore fracture network utilizing pulsed hydraulic stimulation to expand rock connection as well as minimize rock breakdown pressure before tensile stimulation.

Figure 3A:
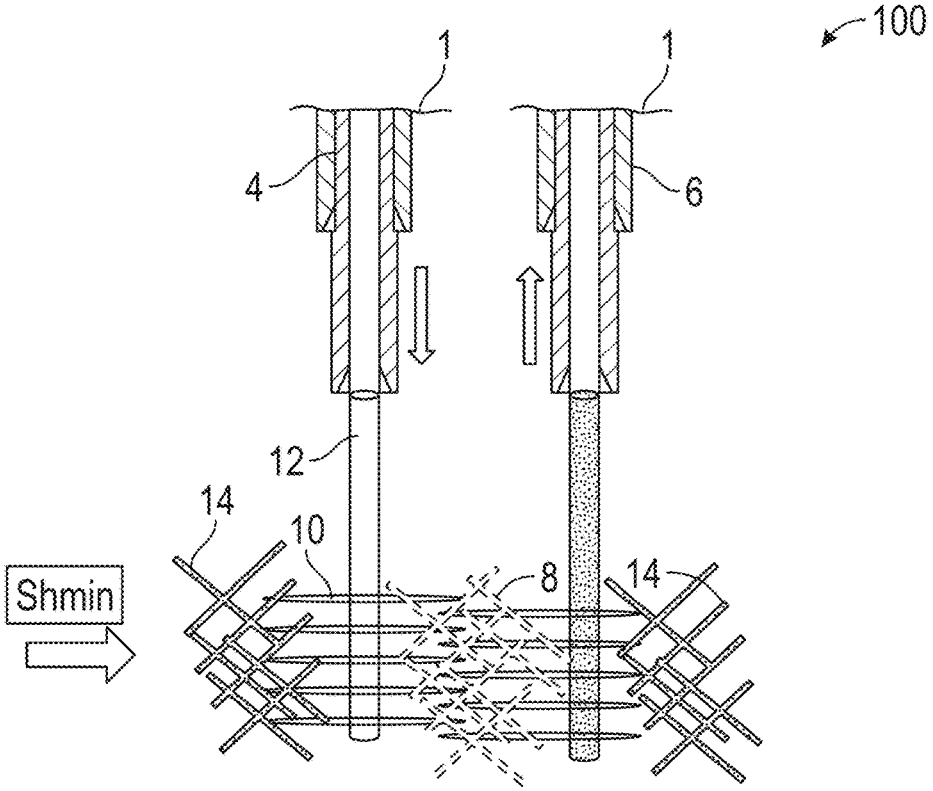
FIGS. 3A and 3B are schematic side elevation views, partially in cross-section, illustrating an embodiment having a vertical injector well and a vertical producer well (FIG. 3A) and an embodiment having a deviated injector well and a vertical producer well (FIG. 3B)
Figure 3B:
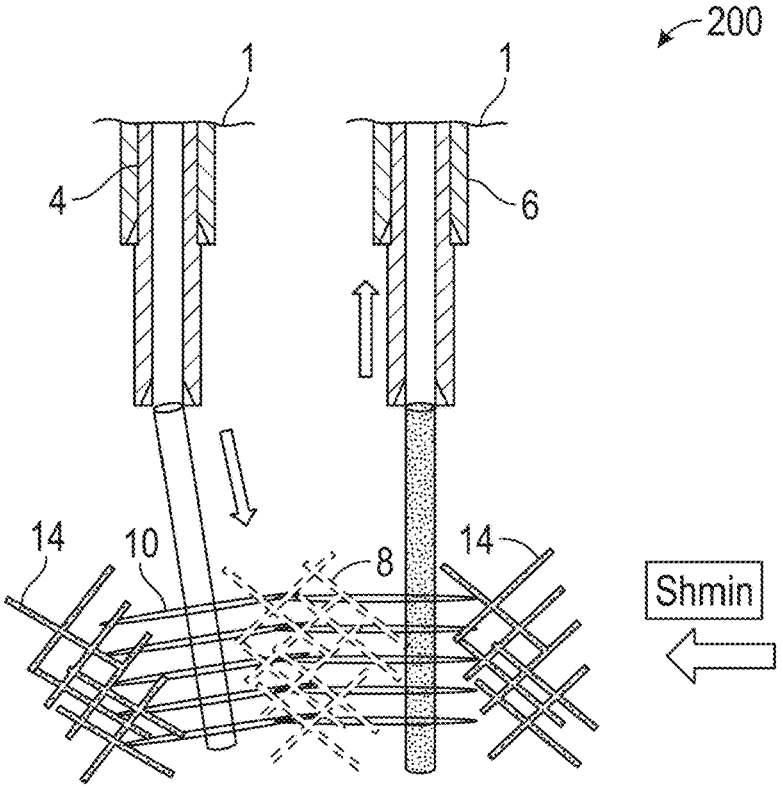

FIGS. 3A and 3B are schematic side elevation views, partially in cross-section, illustrating an embodiment having a vertical injector well 4 and a cased vertical producer well 6 (FIG. 3A), both extending from surface 1 into subterranean geologic formation 2, with arrows illustrating direction of flow of fracturing fluid; and an embodiment 200 having a deviated injector well 4 and a cased vertical producer well 6 (FIG. 3B), both extending from surface 1 into subterranean geologic formation 2, with arrows illustrating direction of flow of stimulating fluid.

Figure 4:
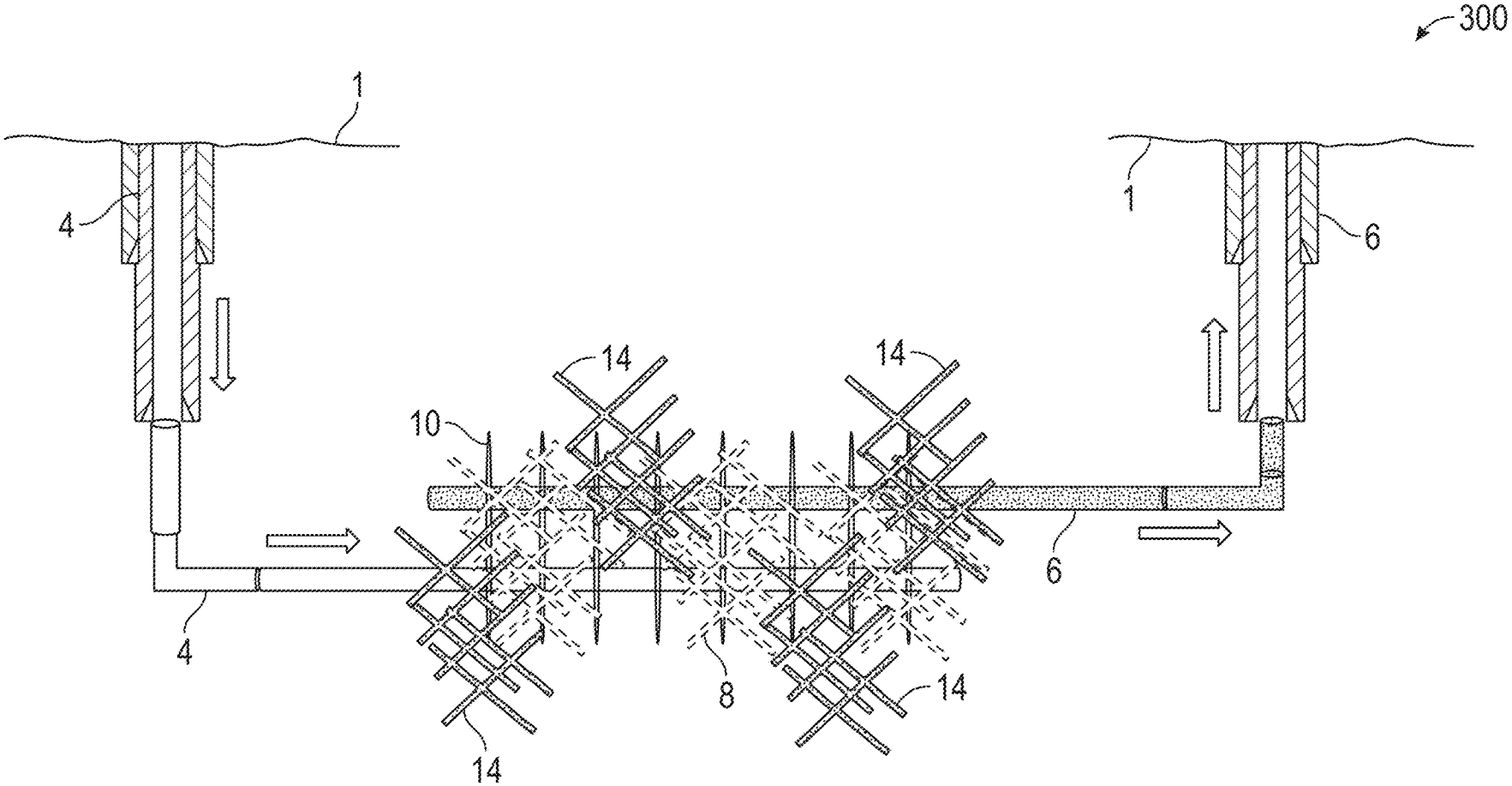
FIG. 4 is a schematic side elevation view, partially in cross-section, illustrating an embodiment having a horizontal injector well and a horizontal producer well.

FIG. 4 is a schematic side elevation view, partially in cross-section, illustrating an embodiment 300 having an injector well 4 having a horizontal portion, and a producer well 6 also having a horizontal portion.

Figure 5:
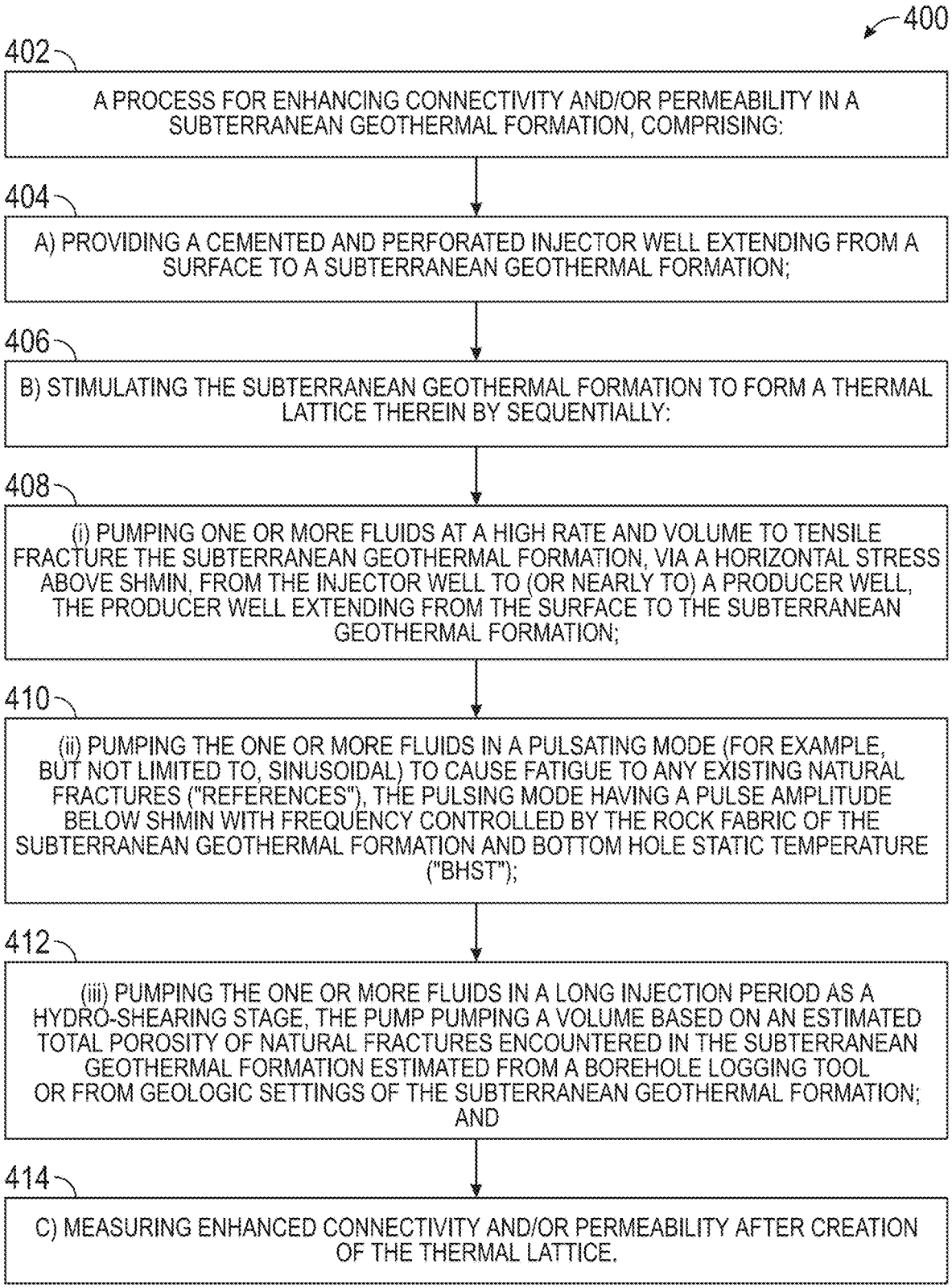
FIG. 5 is logic diagram illustrating one process in accordance with the present disclosure.

FIG. 5 is logic diagram illustrating one process embodiment 400 in accordance with the present disclosure. Process embodiment 400 is a process for enhancing connectivity and/or permeability in a subterranean geologic formation (box 402), comprising:

(a) providing a perforated (cemented or uncemented) injector well extending from a surface to a subterranean geologic formation (box 404);

(b) stimulating the subterranean geologic formation to form a thermal lattice therein by sequentially (box 406):

(i) pumping one or more fluids at a high rate and volume to tensile fracture the subterranean geologic formation, generating a downhole pressure that produces a stress on the subterranean geologic formation exceeding Shmin, from the injector well to (or nearly to) a producer well, the producer well extending from the surface to the subterranean geologic formation (box 408);

(ii) pumping the one or more fluids in a pulsating mode (for example, but not limited to, sinusoidal) to cause fatigue to any existing natural fractures ("references") intersecting the tensile fracture, or to natural non-fractured rock, the pulsing mode having a pulse amplitude below Shmin with frequency controlled by the rock fabric of the subterranean geologic formation and bottom hole static temperature ("BHST") (box 410);

(iii) pumping the one or more fluids in a long injection period as a hydro-shearing stage, the pump pumping a volume based on an estimated total porosity of natural fractures encountered in the subterranean geologic formation estimated from a borehole logging tool or from geologic settings of the subterranean geologic formation (box 412); and (c) measuring enhanced connectivity and/or permeability after creation of the thermal lattice (box 414).

Figure 6:
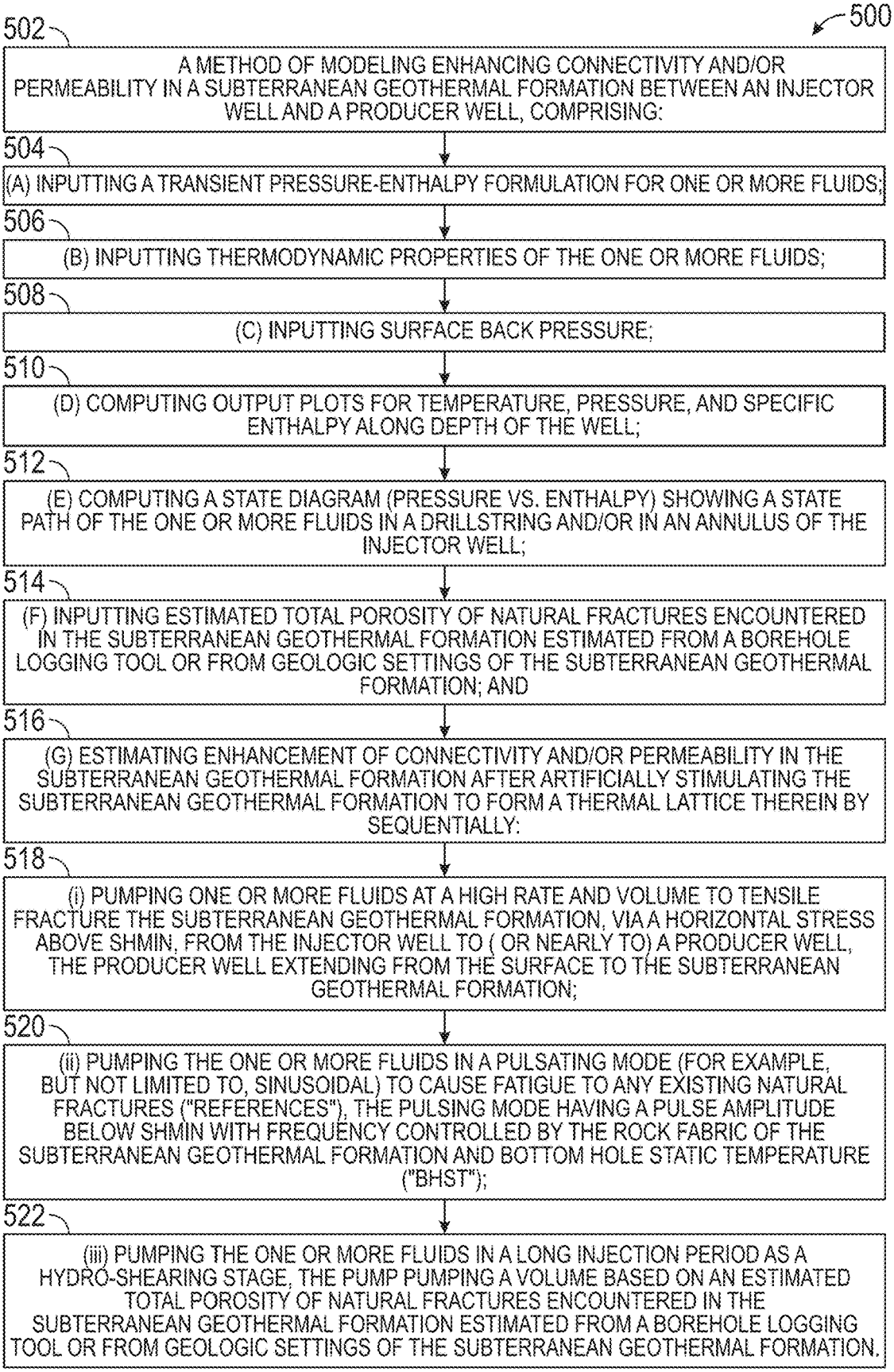
FIG. 6 is a logic diagram illustrating one modeling method in accordance with the present disclosure.

FIG. 6 is a logic diagram illustrating one modeling method embodiment 500 in accordance with the present disclosure. Embodiment 500 is a method of modeling enhancing connectivity and/or permeability in a subterranean geologic formation between an injector well and a producer well (box 502), comprising:

(a) inputting thermodynamic properties of one or more stimulation fluids (box 504);

(b) inputting estimated total porosity of natural fractures encountered in the subterranean geologic formation estimated from a borehole logging tool or from geologic settings of the subterranean geologic formation (box 506); and (c) estimating enhancement of connectivity and/or permeability in the subterranean geologic formation after artificially stimulating the subterranean geologic formation with the stimulation fluid to form a thermal lattice therein by sequentially (box 508):

(i) pumping one or more fluids at a high rate and volume to tensile fracture the subterranean geologic formation, generating a downhole pressure that produces a stress on the subterranean geologic formation exceeding Shmin, from the injector well to (or nearly to) a producer well, the producer well extending from the surface to the subterranean geologic formation (box 510);

(ii) pumping the one or more fluids in a pulsating mode (for example, but not limited to, sinusoidal) to cause fatigue to any existing natural fractures ("references") intersecting the tensile fracture, or to natural non-fractured rock, the pulsing mode having a pulse amplitude below Shmin with frequency controlled by the rock fabric of the subterranean geologic formation and bottom hole static temperature ("BHST") (box 512);

(iii) pumping the one or more fluids in a long injection period as a hydro-shearing stage, the pump pumping a volume based on an estimated total porosity of natural fractures encountered in the subterranean geologic formation estimated from a borehole logging tool or from geologic settings of the subterranean geologic formation (box 514).

In certain embodiments, the modeling method outputs may include:

Return Annulus Surface Temperature (° C.);

Temperature at stimulation fluid injection location (C);

Fluid Temperature at surface, at or near fluid injection position (C);

Pump/Standpipe Pressure (psi);

Fluid Pressure at surface, at or near fluid injection position (psi); Annular Velocity of stimulation fluid (m/s);

Density of stimulation fluid at surface, at injection point ($kg/m^3$);

Plus various graphical displays of pressure and temperature profiles, state curve in p-H diagram, profiles of other properties (density, specific heat, and the like).

Operationally, the pump or pumps may operate at up to 20,000 psi pump pressure rating typical for land rigs. Certain embodiments may include specialized equipment, such as high pressure pumps, coiled tubing rigs, and combinations thereof. Standpipe pressure (SPP) above 15,000 psi is considered extreme. For this case study, we notionally target between 3,000 psi and 10,000 psi standpipe pressure.

Control devices may comprise a combination of: one or more pressure control devices, also referred to as chokes; one or more temperature control devices; one or more stimulation fluid pumping devices; one or more flow measurement devices (also referred to herein as mass flow meters or mass flow sensors); and in certain embodiments one or more accessory equipment such as one or more connectors, one or more isolation valves, one or more pressure relief devices, among others. The specific configuration of the well, drillstring, and fracturing sequences define the capabilities of each system and process embodiments. Redundancy of components may allow for extended service periods and mitigates risk of downtime due to component failure. An example would be a pressure control device (choke) plugging with drilled cuttings, or washout due to erosion. In this case, isolating the failed component and enabling another one allows for continued operations, and enables evaluation and/or modification of the operational parameters to minimize the risk of failure of the new component in use.

A dedicated contingency pressure control device may be used to quickly react to sudden increases in pressure, potentially due to one or more operational pressure control devices plugging, or other reasons. This contingency pressure control device may be controlled by an automated system to open and regulate a maximum pressure set point providing time to enable additional flow paths to bypass the blocked component, if available, or to stop operations to correct the deviation.

A mass flow meter may enable monitoring the stimulation fluid flow rates, and aid in comparison of fluid flow and density out of the producer well against fluid flow and density being pumped into the injector well.

During operation, one or all of T, P, mass flow rate, gas or vapor concentrations (or percentages of set point values) inside and/or outside the tubing and in the annulus may be displayed locally on Human Machine Interface (HMI), such as a laptop computer having display screen having a graphical user interface (GUI), or handheld device, or similar. In certain embodiments the HMI may record and/or transmit the data via wired or wireless communication to another HMI, such as a laptop, desktop, or hand-held computer or display. These communication links may be wired or wireless.

One or more control strategies may be employed. A pressure process control scheme may be employed, for example in conjunction with the pressure control devices and mass flow controllers. A master controller may be employed, but the disclosure is not so limited, as any combination of controllers could be used. Programmable logic controllers (PLCs) may be used.

Control strategies may be selected from proportional-integral (PI), proportional-integral-derivative (PID) (including any known or reasonably foreseeable variations of these), and may compute a residual equal to a difference between a measured value and a set point to produce an output to one or more control elements. The controller may compute the residual continuously or non-continuously. Other possible implementations of the disclosure are those wherein the controller comprises more specialized control strategies, such as strategies selected from feed forward, cascade control, internal feedback loops, model predictive control, neural networks, and Kalman filtering techniques.

Injector wells, producer wells, pumps, and other components described herein may be built to meet ISO standards, Det Norske Veritas (DNV) standards, American Bureau of Standards (ABS) standards, American Petroleum Institute (API) standards, and/or other standards.

In certain embodiments, internal algorithms in the logic device, such as a PLC, may calculate a rate of increase or decrease in pressure inside the tubing and/or annulus. This may then be displayed or audioed in a series of ways such as "percentage to shutdown" lights or sounds, and the like on one or more GUIs. In certain embodiments, an additional function within a HMI may be to audibly alarm when the calculated pressure rate of increase or decrease reaches a level set by the operator. In certain embodiments this alarm may be sounded at the well site, as well as remote from the well site, for example in a shipboard control room, or remote control room.

What has not been recognized or realized are systems and processes for enhancing connectivity and/or permeability in a subterranean geologic formation, in particular geothermal formations, that are robust and safe. What also has not been recognized or realized are methods of modeling enhancing connectivity and/or permeability in a subterranean geologic formation. Systems and processes to accomplish this without significant risk to workers is highly desirable.

Thus the systems, processes, and modeling methods described herein afford ways to perform enhancing connectivity and/or permeability in a subterranean geologic formation efficiently, safely and economically, and with significantly reduced risk of injury and discomfort to site workers.

From the foregoing detailed description of specific embodiments, it should be apparent that patentable systems, processes, and modeling methods have been described. Although specific embodiments of the disclosure have been described herein in some detail, this has been done solely for the purposes of describing various features and aspects of the systems and processes, and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, some systems of this disclosure may be devoid of certain components and/or features: for example, systems devoid of cyclone separators, or devoid of filters; systems devoid of low-strength steels; systems devoid of threaded fittings; systems devoid of welded fittings; systems devoid of casing. Some pulsating fracturing modes may employ pulses other than sinusoidal pulses, for example, but not limited to, step pulses.

What is claimed is:

1. A system comprising:

(a) an injector well extending from a surface to a subterranean geologic formation and configured to be perforated;

(b) a pump configured to produce a thermal lattice in the subterranean geologic formation by:

(i) pumping a first volume of one or more fluids capable of tensile fracturing the subterranean geologic formation, generating a downhole pressure that produces a stress on the subterranean geologic formation exceeding a minimum horizontal stress of the subterranean geologic formation, from the injector well to a producer well, the producer well extending from the surface to the subterranean geologic formation;

(ii) pumping the one or more fluids in a pulsing mode to cause fatigue to any existing natural fractures intersecting fractures caused by the tensile fracturing, or to natural non-fractured rock, the pulsing mode having a pulse amplitude below the minimum horizontal stress of the subterranean geologic formation with frequency determined by rock fabric of the subterranean geologic formation and bottom hole static temperature;

(iii) pumping a second volume of the one or more fluids during an injection period as a hydro-shearing stage, the second volume based on an estimated total porosity of natural fractures encountered in the subterranean geologic formation estimated from a borehole logging tool or from geologic settings of the subterranean geologic formation; and (c) a measurement sub-system configured to measure enhanced connectivity or permeability or both of the subterranean geologic formation after creation of the thermal lattice.

2. The system of claim 1 wherein the subterranean geologic formation is a geothermal formation, and the injector well and producer wells are in dry hot rock.

3. The system of claim 1 wherein the production well is selected from an open hole, a well comprising an uncemented liner, and a well selectively segmented by embedded cylinder pipe and sliding sleeves or pre-perforated liner.

4. The system of claim 1 wherein the measurement sub-system configured to measure enhanced connectivity or permeability or both of the subterranean geologic formation after creation of the thermal lattice is configured to measure improvement in injectivity index.

5. The system of claim 1 wherein the measurement sub-system configured to measure enhanced connectivity and/or permeability of the subterranean geologic formation after creation of the thermal lattice is configured to measure pressure decline as compared by calculation of geothermal transmissivity $Kh/\mu$ improvement of the existing natural fractures intersecting the tensile fracture, where Kh is horizontal conductivity and $\mu$ is fluid viscosity.

6. The system of claim 1 wherein the pump is a surface pump.

7. The system of claim 6 wherein the surface pump is configured to operate at pump pressure rating between 3,000 psi and 10,000 psi standpipe pressure.

8. The system of claim 1 wherein the one or more fluids is selected from water, brine, viscosified fluids, energizing fluids, and polymer based fluids.

9. The system of claim 1 wherein the injector well is selected from vertical, deviated, and horizontal injector wells.

10. The system of claim 1 wherein the injector well is configured to utilize single-path injection through either an inner conduit or through an annulus between the inner conduit and casing, wherein the inner conduit is selected from in place tubing, drill pipe, and coiled tubing.

11. The system of claim 1 wherein the injector well is configured to utilize dual injection paths comprising a first injection path through an inner conduit and a second injection path through an annulus between the inner conduit and casing, wherein the pump comprises a first pump for the first injection path and a second pump for the second injection path, and wherein the inner conduit is selected from in place tubing, drill pipe, and coiled tubing.

12. The system of claim 11 wherein the one or more fluids comprises a first fluid configured to be pumped by the first pump through the first injection path, and a second fluid configured to be pumped by the second pump through the second injection path, wherein the first and second fluids are different in one or more physical or chemical properties.

13. The system of claim 1 wherein the one or more fluids comprises a propping agent.

14. A process comprising:

(a) providing a cemented and perforated injector well extending from a surface to a subterranean geologic formation; and (b) stimulating the subterranean geologic formation to form a thermal lattice therein by sequentially:

(i) pumping a first volume of one or more fluids to tensile fracture the subterranean geologic formation, generating a downhole pressure that produces a stress on the subterranean geologic formation exceeding a minimum horizontal stress of the subterranean geologic formation, from the injector well to a producer well, the producer well extending from the surface to the subterranean geologic formation;

(ii) pumping the one or more fluids in a pulsing mode to cause fatigue to any existing natural fractures intersecting fractures caused by the tensile fracture, or to natural non-fractured rock, the pulsing mode having a pulse amplitude below the minimum horizontal stress of the subterranean geologic formation with frequency controlled by rock fabric of the subterranean geologic formation and bottom hole static temperature;

(iii) pumping a second volume of the one or more fluids during an injection period as a hydro-shearing stage, the second volume based on an estimated total porosity of natural fractures encountered in the subterranean geologic formation estimated from a borehole logging tool or from geologic settings of the subterranean geologic formation; and (c) measuring enhanced connectivity or permeability or both after creation of the thermal lattice.

15. The process of claim 14 wherein the subterranean geologic formation is a geothermal formation, and the injector well and the producer well are in dry hot rock.

16. The process of claim 14 wherein the producer well is selected from an open hole, a well comprising a cemented or an uncemented liner, and a well selectively segmented by embedded cement pipe and sliding sleeves or pre-perforated liner.

17. The process of claim 14 wherein the measuring of enhanced connectivity and/or permeability of the subterranean geologic formation after creation of the thermal lattice comprises measuring improvement in injectivity index.

18. The process of claim 14 wherein the measuring of enhanced connectivity and/or permeability of the subterranean geothermal formation after creation of the thermal lattice comprises measuring pressure decline as compared by calculation of geothermal formation transmissivity Kh/μ improvement of the existing natural fractures intersecting the tensile fracture, where Kh is horizontal conductivity and μ is fluid viscosity.

19. The process of claim 14 wherein the one or more fluids is selected from water, brine, viscosified fluids, energizing fluids, and polymer based fluids.

20. The process of claim 14 wherein the injector well is selected from vertical, deviated, and horizontal injector wells.

21. The process of claim 14 wherein the pumping utilizes single-path injection through either an inner conduit or through an annulus between the inner conduit and casing of the injector well, wherein the inner conduit is selected from in place tubing, drill pipe, and coiled tubing.

22. The process of claim 14 wherein the pumping utilizes dual injection paths comprising pumping in a first injection path through an inner conduit and pumping in a second injection path through an annulus between the inner conduit and casing, and wherein the pump comprises a first pump for the first injection path and a second pump for the second injection path, and wherein the inner conduit is selected from in place tubing, drill pipe, and coiled tubing.

23. The process of claim 22 wherein the one or more fluids comprises a first fluid pumped by the first pump through the first injection path, and a second fluid pumped by the second pump through the second injection path, wherein the first and second fluids are different in one or more physical or chemical properties.

24. The process of claim 14 wherein the one or more fluids comprises a propping agent.

* * * * *